US006550824B1

(12) United States Patent
Ramsauer

(10) Patent No.: US 6,550,824 B1
(45) Date of Patent: Apr. 22, 2003

(54) SPRING-LOADED CATCH FOR A SLIDING DOOR OF A SHEET METAL CUPBOARD

(76) Inventor: Dieter Ramsauer, Am Neuhauskothen 20, D-42555 Velbert (DE)

( * ) Notice: Subject to any disclaimer, the term of this patent is extended or adjusted under 35 U.S.C. 154(b) by 0 days.

(21) Appl. No.: 09/646,846

(22) PCT Filed: Mar. 13, 1999

(86) PCT No.: PCT/EP99/01670

§ 371 (c)(1),
(2), (4) Date: Dec. 14, 2000

(87) PCT Pub. No.: WO99/49158

PCT Pub. Date: Sep. 30, 1999

(30) Foreign Application Priority Data

Mar. 25, 1998 (DE) ..... 298 05 358 U

(51) Int. Cl.[7] ..... E05C 19/10

(52) U.S. Cl. ..... 292/126; 292/100; 292/226; 292/200; 292/11; 292/29; 292/52

(58) Field of Search ..... 292/126, 122, 292/121, 100, 226, 200, 11, 29, 52; 49/449, 370, 116

(56) References Cited

U.S. PATENT DOCUMENTS

| | | | | | |
|---|---|---|---|---|---|
| 1,073,057 | A | * | 9/1913 | Schmid | 16/85 |
| 1,075,367 | A | * | 10/1913 | Merritt | 292/121 |
| 2,891,816 | A | * | 6/1959 | Meats | 105/310.1 |
| 3,596,954 | A | * | 8/1971 | Hull et al. | 292/128 |
| 4,915,428 | A | * | 4/1990 | Hayakawa | 292/29 |
| 5,092,144 | A | | 3/1992 | Fleming et al. | |
| 5,775,140 | A | * | 7/1998 | Hallsten | 292/128 |
| 6,264,252 | B1 | * | 7/2001 | Clancy | 292/123 |
| 6,357,803 | B1 | * | 3/2002 | Lorek | 292/124 |

FOREIGN PATENT DOCUMENTS

| | | |
|---|---|---|
| FR | 1.082.499 | 12/1954 |
| FR | 2 112 850 | 7/1983 |
| GB | 143192 | 10/1920 |

* cited by examiner

*Primary Examiner*—J. J. Swann
*Assistant Examiner*—Matthew E. Rodgers
(74) *Attorney, Agent, or Firm*—Reed Smith LLP

(57) ABSTRACT

Disclosed is a snap lock device for a sliding door of a machine casing, which sliding door is preferably reinforced on at least one side by a sheet metal fold or a hollow rectangular profile, with a handle which is swivelably mounted at the reinforced side of the sliding door and which cooperates with a latch bolt device, and with a retaining device for receiving the latch bolt when the door is closed, this retaining device being arranged on or accommodated in a door frame or in a profile defining an opening in the machine casing. The handle comprises a bar whose ends are supported around a swivel pin extending parallel to the reinforced side of the door leaf and located behind the door leaf or inside the sheet metal fold or hollow profile, the ends of the bar being received in a bar holder, and at least one of the two bar holders is coupled with a hook which is mounted so as to be swivelable coaxially to the swivel pin and has free travel and forms the lock latch.

17 Claims, 5 Drawing Sheets

SPRING-LOADED CATCH FOR A SLIDING DOOR OF A SHEET METAL CUPBOARD

BACKGROUND OF THE INVENTION a) Field of the Invention

The invention is directed to a spring-loaded catch or snap lock for a sliding door or the like of a machine casing or the like, which sliding door is preferably reinforced on at least one side by a sheet metal fold or a hollow rectangular section or profile, wherein the lock is mounted in a receiving space formed by the sheet metal fold or hollow rectangular profile, with a handle which is swivelably mounted at the reinforced side of the sliding door and which cooperates with a latch bolt device, and with a retaining device for receiving the latch bolt when the door is closed, this retaining device being arranged on or accommodated in a door frame or a profile defining an opening in the machine casing.

b) Description of the Related Art

Snap locks of the type mentioned above are already known to the present Applicant. The known arrangement is disadvantageous, among other reasons, because a latch handle that must be swiveled for opening is normally utilized for opening the snap lock, whereupon the lock is released and the sliding door can be slid open by continued pressing against the latch handle. This latch handle has the disadvantage that clothing can catch on it, which cannot be tolerated in dangerous situations. A further disadvantage is that the handle can be in an inclined position with respect to the sliding direction due to the swiveling process so that increased pressing force must be exerted on the latch handle and, moreover, there is a tendency for the hand to slip off the latch handle in its inclined position. A third disadvantage is the unattractive appearance of such a latch handle.

GB-A-143,192 discloses a construction corresponding to a first embodiment form of the novel lock to be described herein. This construction has a housing which is fitted into a recess formed by the door and which has, on one side, a flange resting on the door surface, while a corresponding shaped piece is arranged on the other side of the door (see page 2, lines 27–32 of this reference). Apart from the essential features mentioned above, this reference further discloses the additional features that the handle is a rod which is mounted at the ends about a swiveling axis extending parallel to the side of the door leaf provided with the recess, the ends of the rod being received in a rod holder, and that at least one of the two rod holders is coupled with a freerunning hook which is mounted so as to be swivelable about an axis extending parallel to the swiveling axis of the rod and forms the latch bolt.

FR-A-1.082.499 discloses a lock in which the axis of the hook is vertical to the swiveling axis of the rod and, to this extent, corresponds to another embodiment form of the novel lock.

Neither of these known locks is suitable for sheet metal cabinet doors. In addition, the lock in GB-A-143,192 requires that a specially shaped recess which is complicated to produce is made in the door. The lock in FR-A-1.082.499 can not be accommodated either in a hollow rectangular profile or in the fold space of sliding doors formed from sheet metal by bending.

OBJECT AND SUMMARY OF THE INVENTION

It is the primary object of the invention to improve a snap lock of the type mentioned above in such a way that the disadvantages noted above are entirely prevented as far as possible.

The object is met according to a first embodiment of a snap lock for a sliding door in a machine casing, which sliding door is reinforced on at least one side by a sheet metal fold or a hollow rectangular profile. The lock is mounted in a receiving space formed by the sheet metal fold or hollow rectangular profile. The lock has a handle which is swiveably mounted at the reinforced side of the sliding door and which cooperates with a latch bolt device. The lock includes a retaining device for receiving the latch bolt when the door is closed. The retaining device is arranged on or accommodated in a door frame or a profile defining an opening in the machine casing. The handle comprises a bar which is supported at the ends by a swivel pin extending parallel to the reinforced side of the door leaf and located behind the door leaf or inside the sheet metal fold or hollow profile. A bar holder is provided for receiving the ends of the bar. At least one of two bar holders is coupled with a hook which is mounted so as to be swivelable coaxially to the swivel pin and has free travel and forms a lock latch. A swivel support for the bar holder is formed by a profile piece which is provided with a fastening flange and which is received in a rectangular opening in the sheet metal fold or in the hollow profile of the door leaf.

In a second embodiment, a snap lock for a sliding door in a machine casing, which sliding door is reinforced on at least one side by a sheet metal fold or a hollow rectangular profile also meets the object of the invention. The lock is mounted in a receiving space formed by the sheet metal fold or hollow rectangular profile. The lock has a handle which is swivelably mounted at the reinforced side of the sliding door and which cooperates with a latch bolt device. The lock includes a retaining device for receiving the latch bolt when the door is closed. The retaining device is arranged on or accommodated in a door frame or a profile defining an opening in the machine casing. The handle comprises a bar which is supported at the ends thereof around a swivel pin extending parallel to the reinforced side of the door leaf and located behind the door leaf or inside the sheet metal fold or hollow profile. A bar holder is provided for receiving the ends of the bar holder. At least one of two bar holders engages with a hook which is mounted around a bar vertical to the swivel pin and forms the lock latch. A bearing support for the bar holder is formed by a profile piece which is provided with a fastening flange and which is received in a rectangular opening in the sheet metal fold or in the hollow profile of the door leaf.

It is achieved by means of these two constructions, first, that there is no hook-shaped handle on which the user's clothes can catch. Further, it is achieved that the orientation of the handle with respect to the movement direction of the sliding door does not change for the user's hand during the process of swiveling because the handle does not rotate with respect to this direction but, rather, is only swiveled and pushed in this direction substantially parallel to the door leaf. The actuating force accordingly acts vertically to the extension of the handle and there is no danger of the hand slipping off of the handle. The handle also has a more aesthetically pleasing form and, on the whole, allows a greater force to be exerted on the sliding door in order to push it. In contrast to the references mentioned above, applicability in sheet metal sliding doors is achieved.

In the first embodiment form, the bearing support for the bar holder is formed by a section piece or profile piece which is provided with a fastening flange and which is received in a rectangular opening in the sheet metal fold or in the hollow profile of the door leaf. This is a particularly stable and attractive arrangement and enables sensible utilization of existing space in the sheet metal fold or hollow profile.

Numerous further developments having their own advantages are made possible by the snap lock according to the invention in accordance with claim 1 and claim 10.

According to a first further development of the first embodiment form, the bar holder, in the area of its bearing support, is a two-pronged fork, the hook being supported between its two prongs. This provides a bearing support which resists tilting and which is particularly stable and smoothly operating and facilitates actuation of the snap lock for automatic latch-type locking when sliding the door closed as well as when releasing and subsequently opening the lock for sliding the door open.

According to another further development of the invention, the fork web between the two fork prongs is provided with two stop faces for limiting the swiveling movement of the hook. This allows the user to determine whether or not the lock has disengaged already by opening until a certain stopping point, so that the sliding door can then be opened.

According to another further development of the invention, the profile piece forms a receptacle for a pressure spring which presses the hook into its closed position. Further, the bar holder can form a receptacle for a spring which forces the bar holder into its rest position. It is especially favorable when the spring is a pressure spring which contacts an inner surface of the profile piece. A particularly simple construction having the additional advantage of great compactness is achieved by means of this step.

The surface of the fastening flange advantageously forms a partial cylinder, wherein the bar holder forms a collar which extends at a slight distance from the flange surface and far enough so that the profile piece opening is covered by the collar during the swiveling movement of the holder. These steps prevent injury to the user.

It is also favorable that the side walls of the profile piece have bore holes which are coaxial to one another and offset relative to the swivel pin and that the hook has a bore hole which is aligned with the bore holes of the side walls when the hook is located in the locked position and the bar receptacle is in the rest position, and that a pin lock can be slid into these bore holes. A secure lock with a particularly simple design can be realized by means of these features.

In another possible further development, this pin lock can be electrically controlled. In this way, it is possible, for example, to prevent the sliding door from opening until required for reasons of security, for example, when a machine is still in operation.

There are also various further developments with respect to the above second embodiment, in which the axis of the hook does not extend coaxial to the swivel pin of the bar, but rather vertical thereto. The hook is then preferably swivelably mounted at an extension of the profile piece and is forced into its locking position, e.g., by the force of gravity. The hook can then be lifted out of this locking position, which was achieved, e.g., by force of gravity or spring force, in that the bar holder forms a cam which slides along a cam path formed by the hook and, in so doing, lifts the hook against the force of gravity when the door is to be opened and the door handle is turned for this purpose.

BRIEF DESCRIPTION OF THE DRAWINGS

The invention is described more fully in the following with reference to embodiment examples shown in the drawings.

DESCRIPTION OF THE PREFERRED EMBODIMENTS

Figure 1:
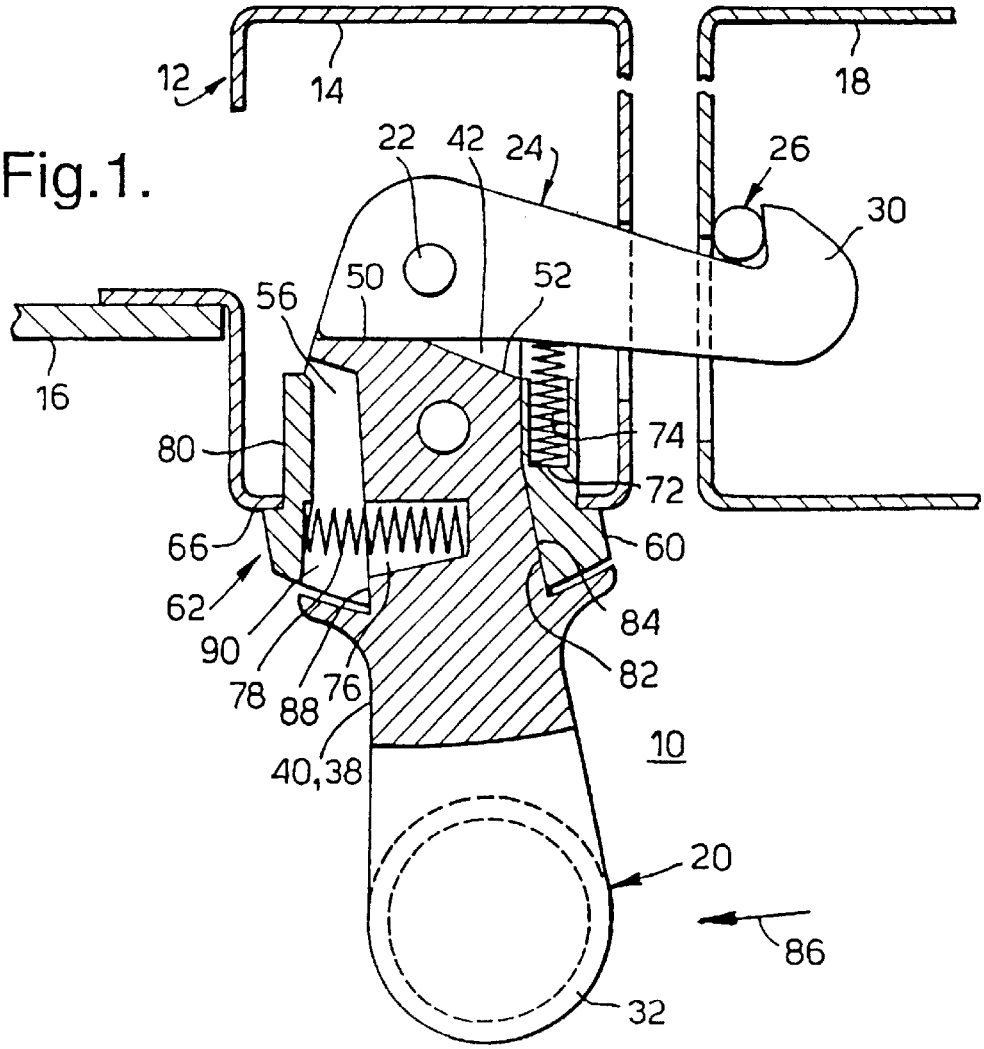
FIG. 1 shows a view in cross section through a snap lock installed in the fold area of the sliding door of a machine casing.
Figure 2:
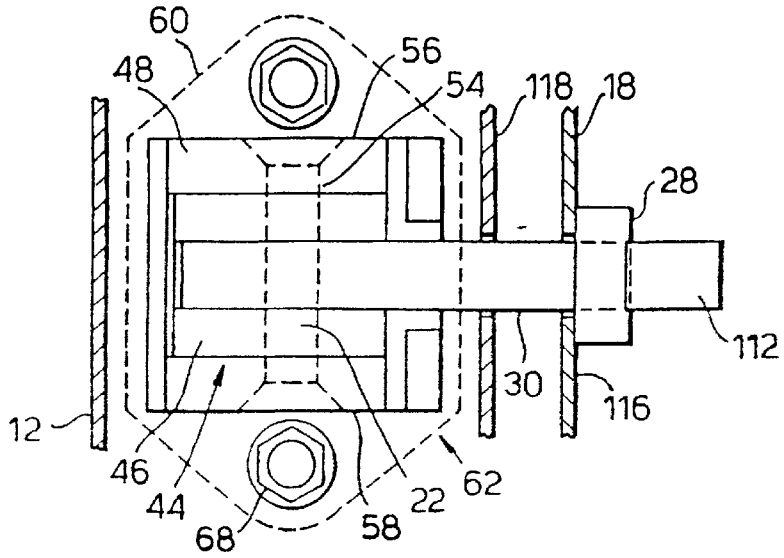
FIG. 2 shows a top view of one of the two bar holders.

FIG. 1 shows a view in cross section through a snap lock 10 for a sliding door 12 which is provided in the area of the snap lock with a sheet metal fold 14 which, in this instance, forms a rectangular hollow profile which is essentially completely closed or partially closed. A profile of this kind can extend circumferentially or can be provided at only one side of the door. The profile accordingly forms a rectangular frame, for example, into which is fitted a plate 16 or a corresponding grating. The sliding door 12 is mounted so as to be displaceable in a manner not relevant in this context within a housing or machine casing 18, for example, by means of rollers, rope suspension or the like such that it can be displaced from a first open position into a second position, shown in FIG. 1, which closes the opening of the machine casing. On or in the side of the sliding door 12 that is reinforced by the fold 14 or profile, a handle 20 is mounted around a swivel pin 22 extending parallel to the reinforced side of the door leaf and located behind the door leaf or inside the sheet metal fold 14 or in the hollow profile and cooperates with a latch in one door sliding direction 24 as will be described in more detail. Further, FIG. 1 shows a retaining device 26 which is arranged on or accommodated in the door frame 18 (or a profile defining an opening of the machine casing) and which is formed, e.g., as a pin that is welded to the sheet metal of the profile 18 according to FIG. 2 and receives a hook 30 formed by the latch bolt device 24 as is shown in FIG. 1. The handle 20 itself is a round bar 32 (see also FIG. 4) which can be constructed as a pipe or as a solid bar. The two ends 34, 36 (see FIG. 3) of the bar 32 are received in a bar holder 38, 40, at least one of which (the upper one in FIG. 4) is provided with a hook 30 which is mounted coaxially about the pin 22 of the holder and which has a coupling 41 provided with free travel and forms the latch 24. The bar holder 40 enclosing the latch comprises a two-pronged fork 44 (see also FIG. 2), the hook 30 being mounted between the two fork prongs 46, 48 so as to be swivelable about a pin axis 22 between a position shown in FIG. 1 and a position shown in FIG. 6.

Figure 6:
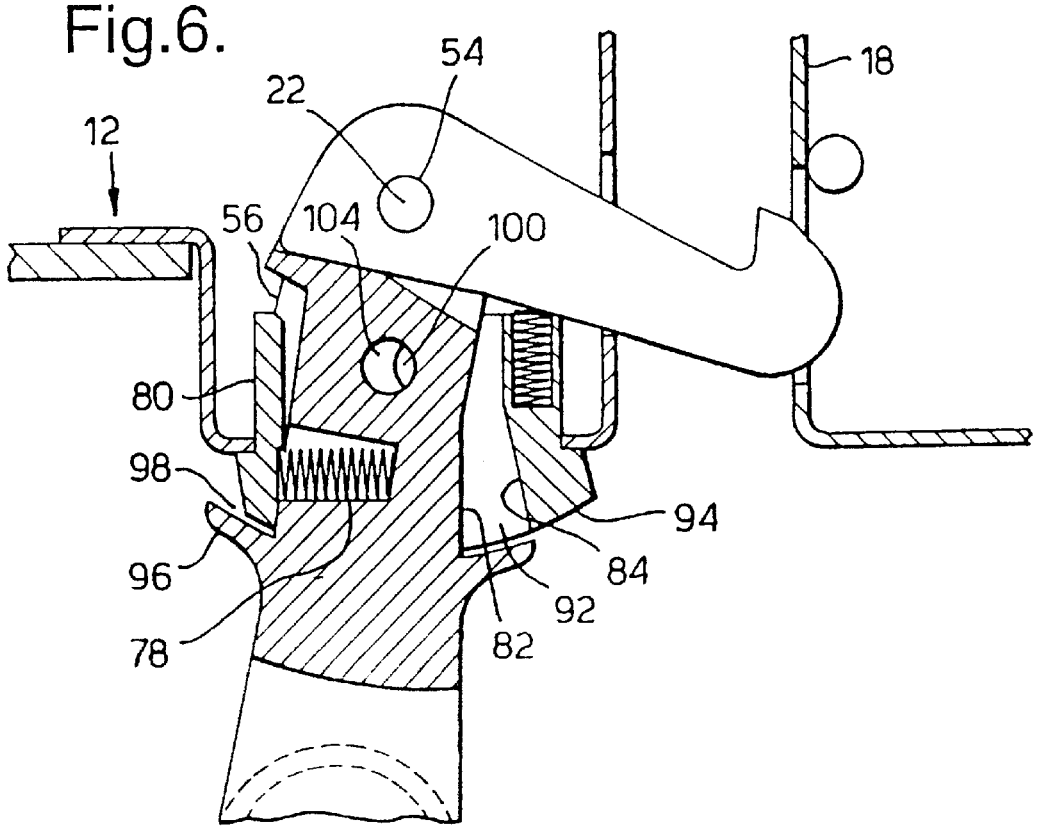
FIG. 6 shows a view similar to FIG. 1 of the snap lock during the opening process.

This swivel path is defined by stop faces 50 and 52 (see FIG. 1) which are formed by the connecting web between the two fork prongs 46, 48. The swivel pin 22 for the hook 30 and also, for example, for the bar holder 40 is formed by a pin 54 which is held in two side walls 56, 58 of a profile piece 62 provided with fastening flange 60. The profile piece 62 is accommodated in a rectangular opening 64 in the outer surface 66 of the sliding door 12 and is fastened by means of cap screws 68 which are guided through matching openings next to the rectangular opening 64 in the side wall 66 and can be screwed into corresponding threaded bore holes 70 in the flange 60. This profile piece 62 not only supports the bearing pin 54 for the bar holder 38 and 40 and hook device 30 (see FIG. 3), but also forms the holder or receptacle 72 for a pressure spring 74 which (see FIG. 1) acts on the hook 30 in such a way that the latter is pressed into its locking position. As is further shown in FIG. 1, the bar holder 40 (possibly also 38) has a receptacle 76 for a spring 78 in the form of a helical pressure spring according to FIG. 1, which is supported on the inner surface of the transverse wall 80 of the profile piece 62 and presses against the receptacle 40 or 38 in the rest position (locking position) shown in FIG. 1, in which the surface 82 of the bar holder 40, 38 rests against the opposite transverse wall 84 of the profile piece 62. By pressing on the bar 32 in the direction of arrow 86, that is, in the direction of the sliding opening of the door 12, the holder 40; 38 swivels in clockwise direction about the bearing pin 22, whereupon the holder 40; 38 swivels against the force of spring 78 about the pin 54 into the position shown in FIG. 6. In this position, the surface 88 of the holder 40 or 38 strikes against the inner surface of the transverse wall 80. Accordingly, as is shown in FIG. 1, this swiveling movement necessary for opening requires a gap 90 between the transverse wall 80 and the surface 88 of the holder 40 or 38, which gap 90 is closed when the bar holder is swiveled from the position according to FIG. 1 into the position according to FIG. 6, and a gap 92 between the transverse wall 84 and surface 82, which gap 92 is closed when the bar holder 40 or 38 is swiveled back into the rest position (from the position according to FIG. 6 back into the position according to FIG. 1). This closing movement could cause the user's finger to be pinched when located in the gap 92 or 90. To prevent this, the flange surface 94 forms a partial cylinder whose radius of curvature is formed by the pin 22 of the bearing pin 54; conversely, the bar holder 38 or 40 forms a collar 96 which is located at a slight distance 98 from the flange surface 94 and extends far enough so that it just covers the gap opening of the profile piece 90 or 92 during the swiveling movement of the holder 40 or 38 as can be seen in FIG. 6 or FIG. 1. Therefore, the user's finger tip cannot access the space 92 or 90 formed by the gap in any position of the lever and the user is therefore protected from injury.

Figure 3:
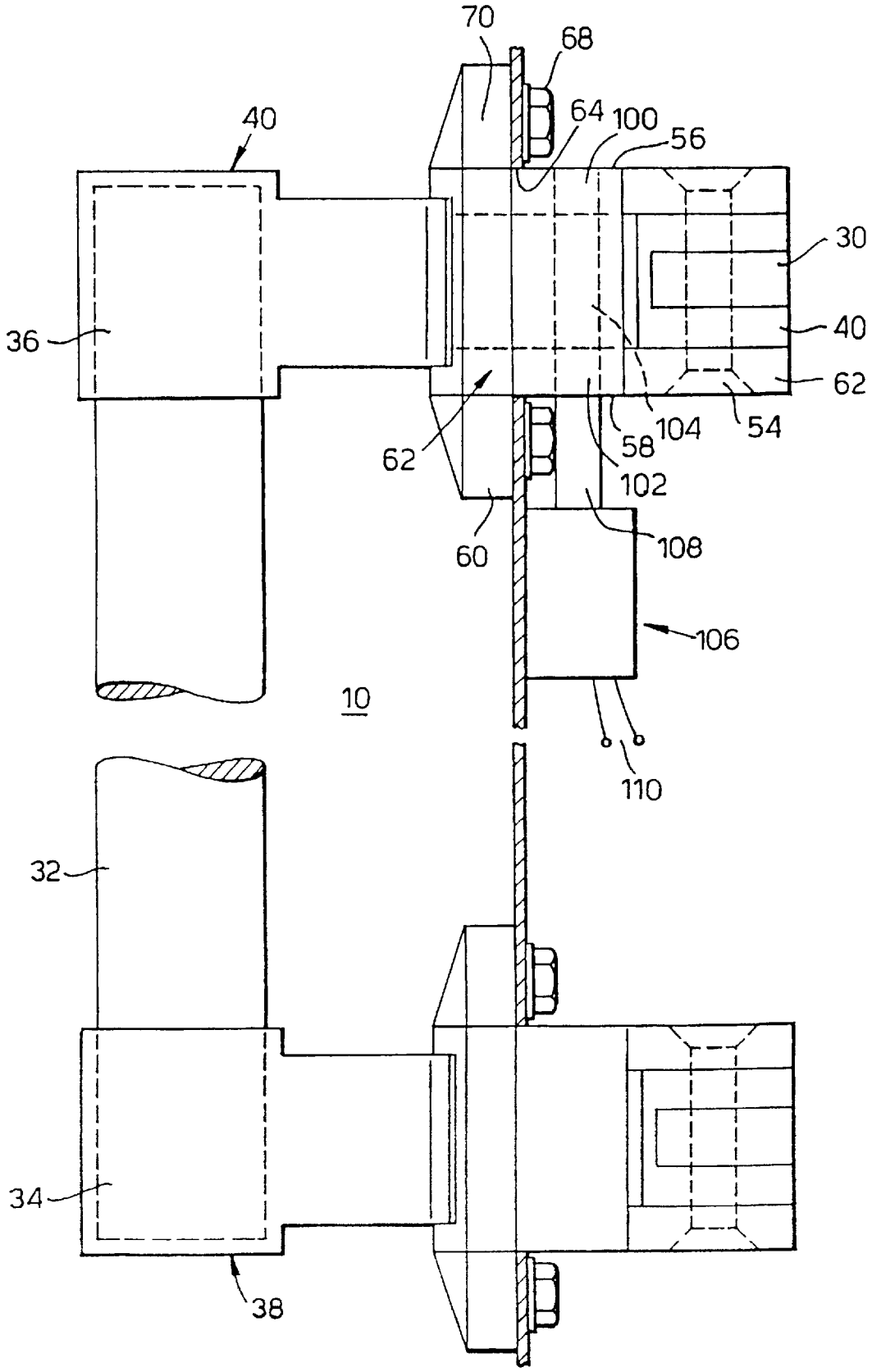
FIG. 3 shows a side view of the snap lock according to FIG. 1.

FIG. 3 shows that the oppositely located side walls 56, 58 of the profile piece 62 have bore holes 100,102 which are coaxial to one another and which are offset relative to the bore hole for the swivel pin 22 and that the holder 40 or 38 has a bore hole 104 which is aligned with the bore holes 100, 102 of the side walls 56, 58 of the profile piece 62 when the holder is in the rest position shown in FIG. 1. A pin 108 can be slid into this position by means of a locking device 106 and, in the slid in position, holds the holder 40 or 38 in the rest position shown in FIG. 1 with respect to the profile piece 62. The pin 108 accordingly prevents a swiveling movement of the holder or of the handle 20 in the direction of the arrow 86. However, when the pin 108 is moved out of the bore holes 100, 102, 104, for example, by means of an electric device controlled via a cable connection 110, the handle 20 can be gripped and the associated holder 40 or 38 can be swiveled about the pin 22 in clockwise direction (according to FIG. 1) by means of the handle 20, whereupon the stop face 50 is pressed against the lever 30 and the latter moves around the pin 22 in clockwise direction. During this movement, the hook 30 is released from the pin 26 of the door frame 18, wherein the spring 74 is compressed at the same time (see FIG. 6). By continued pressing in the direction of arrow 86, the door 12 is now pushed away from the frame 18, first into the position according to FIG. 6, and then farther until the door has released the opening of the housing that was previously closed by the door. The sliding direction is accordingly the same as the releasing direction indicated by arrow 86. The opening movement of the door can proceed horizontally or vertically.

Figure 5:
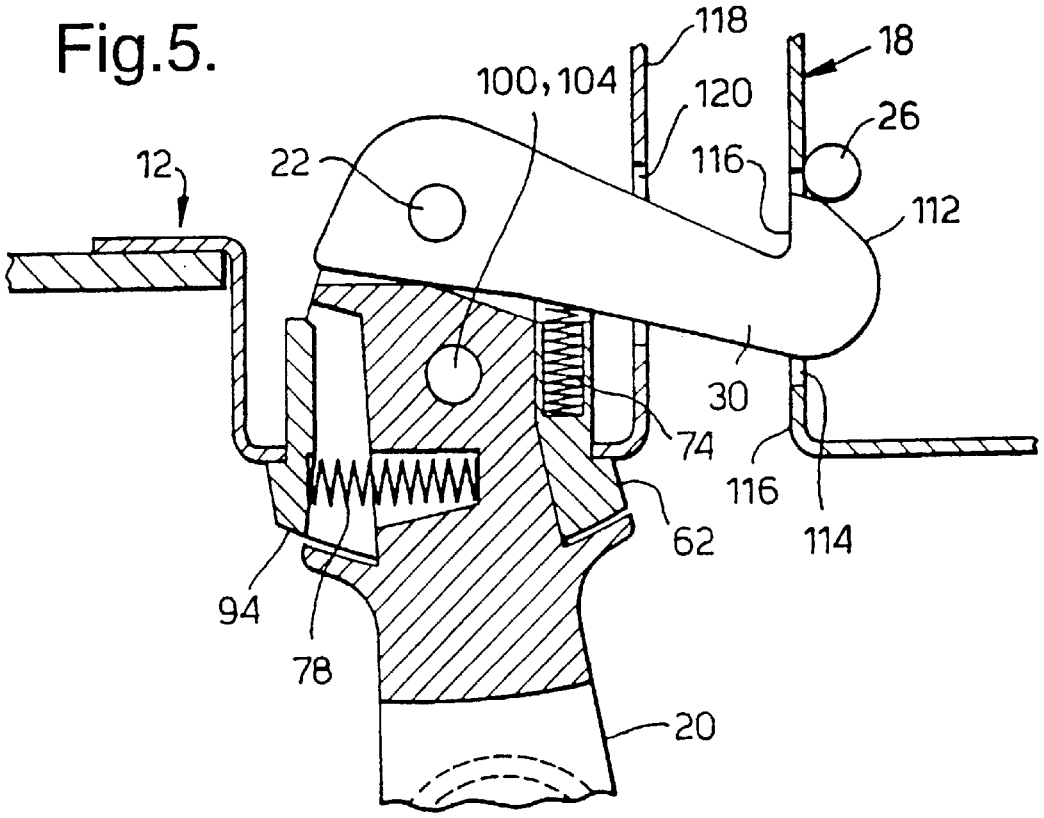
FIG. 5 shows a view similar to FIG. 1 of the snap lock when the sliding door is pushed closed.

When the door is open, the handle can be released and moves into the position shown in FIG. 1 due to the spring force of spring 78. When the door is to be closed again, the lever 20 is grasped again and is now pushed opposite to the direction of arrow 86. At this point, the handle 20 is in the rest position shown in FIG. 5 due to the force of the spring 78 (and also due to the force of the hand actuation). As the door 12 approaches the door frame 18, the front area 112 of the hook 30 initially penetrates a slot 114 in the wall 116 of the frame 18 which is shown in this case with rectangular profile, wherein an inclined surface of the front area 112 strikes a pin 26 arranged inside the profile of the frame 18, this pin 26 being arranged in such a way that it then swivels the hook 30 in clockwise direction about the bearing pin 22 until the hook 30 can slide past the pin 26, as can be seen from FIG. 5. As soon as the position shown in FIG. 1 has been reached, the pressure spring 74 presses the hook 30 again into the locking position shown in FIG. 1 in which the hook engages behind the pin 26 by its end (offset area 116) and accordingly locks the door in the position shown in FIG. 1. In this position, the bore holes 100, 102 and 104 are again aligned and a pin 108 can be pushed into these bore holes so that the lever 30 is fixed in the locking position.

Not until this pin is removed from the bore holes 100, 102 and 104, or at least from bore holes 100 and 104, for example, by an electrical signal supplied via a cable 110, is it possible to swivel the hand lever 20 into its position shown in FIG. 6 and to remove the hook 30 from its locking position and open the sliding door. An electrical signal of the type mentioned above can be generated, for example, when a machine formerly in operation has come to a stop and can be accessed without risk.

It is clear that a slot 120 of suitable length is provided in the wall 118 for the hook 30 to pass through.

Figure 4:
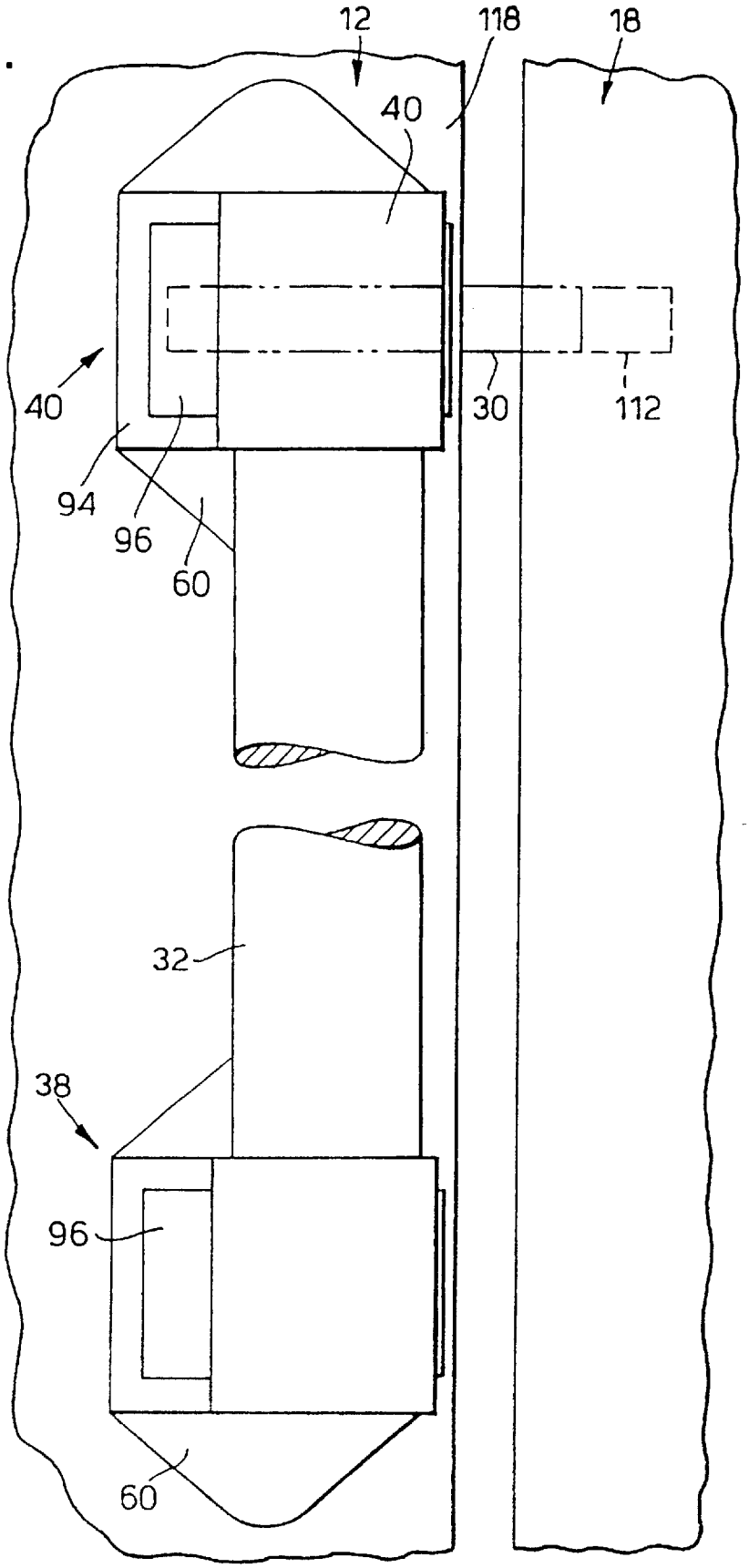
FIG. 4 shows a top view of the snap lock of FIG. 1.

With smoothly operating doors, it is usually sufficient to provide only one of the two bar holders, e.g., the upper holder 40 according to FIG. 3, with a locking hook device 30. However, when larger closing forces are to be absorbed, it is useful to outfit both bar holders with hooks in a corresponding manner according to FIG. 3, that is, both the top and bottom locking bar holders. In FIG. 4 which shows a top view of the lock, the top holder 40, but not the bottom holder, is provided with a locking device 30.

It can also be seen from FIG. 4 that the arrangement is attractive because, e.g., no fastening screws are visible from the outside. A handle which is very stable as a whole and which is suitable for heavy doors is accordingly provided. The round bar 32 is particularly easy to grasp and also makes it possible to adapt to different door heights or door widths. Particularly, the distance between the two holders 40 and 38 is, e.g., 30 cm, 50 cm or 100 cm, depending on the door height (or door width).

According to FIG. 3, the bar 32 is received in the holders 34, 36 in cup receptacles (pocket holes).

The holders differ insofar as the receptacle opening for the round bar 32 is arranged to the left or to the right. However, if the receptacles are through-holes, the top and bottom holders are completely identical, which is advantageous for technical reasons relating to production and storage.

Figure 8:
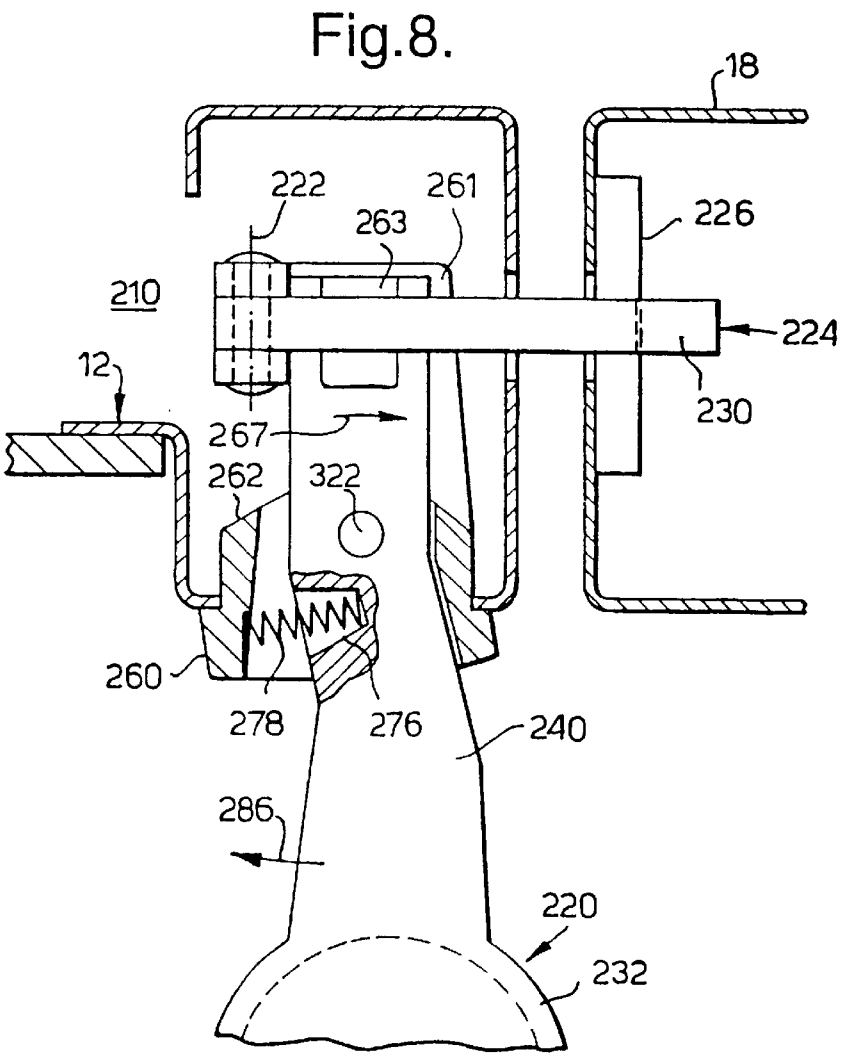
FIG. 8 shows a sectional view of the embodiment form of FIG. 7.

FIG. 8 shows an arrangement similar to that shown in FIG. 1, but in this case the hook 230 is mounted on an extension 161 proceeding from the profile piece 262 so as to be swivelable about a pin 222 located vertical to the pin 322 of the handle 220. Here again, the pin 226 is offset by 90°, that is, parallel to the pin 222. The hook 230 has a cam path 263 along which a cam device 265 can slide, this cam device 265 being supported by the free end of the bar holder 240. When the handle 220 is swiveled about swivel pin 322 in the direction of arrow 286 out of the rest position shown in FIG. 8 against the force of the spring 278, the cam 263 moves out of the position shown in FIG. 8 in the direction of arrow 267 and accordingly presses the hook 230 upward according to FIG. 7 in the direction of arrow 269. The hook 230 swivels about pin 222 and releases the pin 226 in the released position and the sliding door 12 can then be slid closed by further pushing in the direction of arrow 186.

Figure 7:
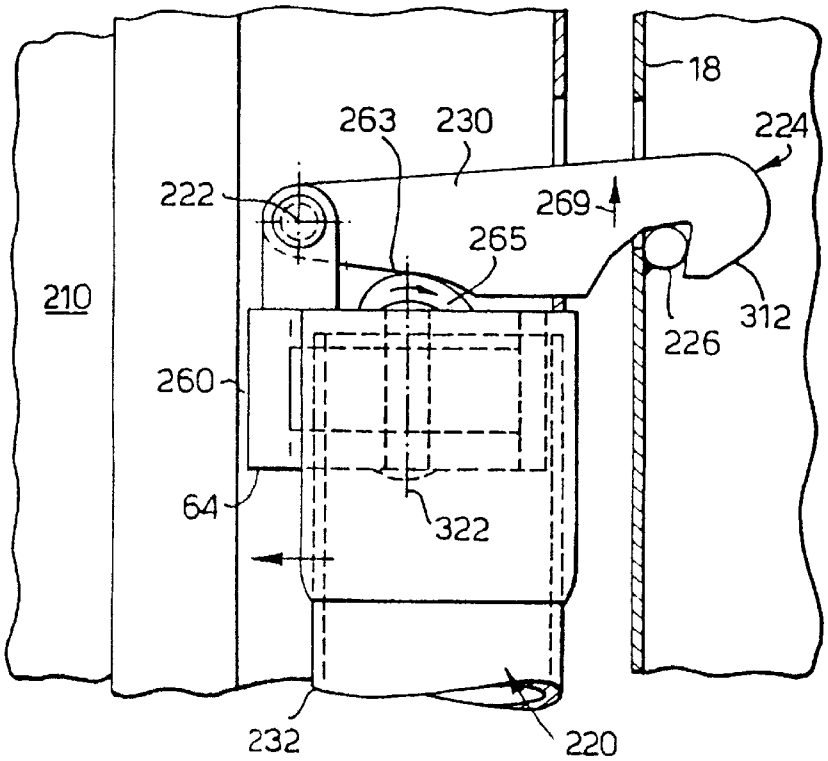
FIG. 7 shows a side view of another embodiment form.

When the handle 220 is released, it moves into the initial position shown in FIG. 8, whereupon the hook 230 moves into its lowered position shown in FIG. 7. It reaches this position either through the force of gravity or due to a pressure spring, not shown here, which could be arranged at the pin 262 or could act on the hook 230 in some other way.

When the door is pushed closed, an inclined surface 312 of the hook reaches the pin 262, is lifted by the latter (in the direction of arrow 269) and the hook finally reaches the lowered position shown in FIG. 7.

Also, in this case, a pin lock can be provided which holds the hand lever 240 in its rest position similar to the arrangement in FIG. 6, so that it cannot be swiveled out of this rest position shown in FIG. 8 and the door cannot be opened.

The invention is commercially applicable in switch cabinet construction.

While the foregoing description and drawings represent the present invention, it will be obvious to those skilled in the art that various changes may be made therein without departing from the true spirit and cope of the present invention.

What is claimed is:

1. A snap lock for a sliding door in a machine casing, which sliding door is reinforced on at least one side by a sheet metal fold or a hollow rectangular profile, comprising:

said lock formed to be mountable in a receiving space formed by the sheet metal fold or hollow rectangular profile;

said lock having a handle which is formed to be swivelably mountable at the reinforced side of the sliding door and which actuates a latch bolt;

said lock including a retaining device for receiving the latch bolt when the door is closed;

said retaining device being formed to be arranged on or accommodated in a door frame or an opening in the machine casing;

said handle comprising a bar the handle being supported at ends thereof by a swivel pin extending after being connected parallel to the reinforced side of the door leaf and located behind the door leaf or inside the sheet metal fold or hollow profile;

bar holders being provided for receiving the ends of the bar;

at least one of the bar holders being coupled with a hook which is mounted so as to be swivelable coaxially to the swivel pin and has free travel and forms said latch bolt; and a swivel support for the bar holder being formed by a profile piece which is provided with a fastening flange and which is formed to be received in a rectangular opening in the sheet metal fold or in the hollow profile of the door leaf.

2. The snap lock according to claim 1, wherein the bar holder, in the area of a bearing support forms a fork with two prongs, the hook being supported between the two prongs of the fork.

3. The snap lock according to claim 2, wherein a web between the two prong of the fork forms two stop faces for limiting the swiveling movement of the hook.

4. The snap lock according to claim 2, wherein the bar holder forms a receptacle for a spring which forces the bar holder into its rest position.

5. The snap lock according to claim 4, wherein the spring is a pressure spring which contacts an inner surface of the profile piece.

6. The snap lock according to claim 2, wherein a surface of the fastening flange forms an opening, and wherein the bar holder forms a collar which extends at a slight distance from the flange surface and far enough that the opening is covered by the collar during a swiveling movement of the holder.

7. The snap lock according to claim 1, wherein the profile piece forms a receptacle for a pressure spring which presses the hook into a closed position.

8. The snap lock according to claim 1, wherein side walls of the profile piece have bore holes which are coaxial to one another and offset relative to the swivel pin, and in that the hook has a bore hole which is aligned with the bore holes of the side walls when the hook is located in a locked position and the bar receptacle is in a rest position, and in that a pin lock is adapted to be slidable into these bore holes.

9. The snap lock according to claim 8, wherein the pin lock is controlled electrically.

10. A snap lock for a sliding door in a machine casing, which sliding door is reinforced on at least one side by a sheet metal fold or a hollow rectangular profile, comprising:

that said lock is mounted in a receiving space formed by the sheet metal fold or hollow rectangular profile;

said lock having a handle which is swivelably mounted at the reinforced side of the sliding door and which actuates a latch bolt device;

said lock including a retaining device for receiving the latch bolt when the door is closed;

said retaining device being arranged on or accommodated in a door frame or an opening in the machine casing;

said handle comprising a bar the handle being supported at ends thereof around a swivel pin extending parallel to the reinforced side of the door leaf and located behind the door leaf or inside the sheet metal fold or hollow profile;

bar holders are provided for receiving the ends of the bar;

at least one of the bar holders engaging with a hook which is mounted around a bar vertical to the swivel pin and forming the latch bolt device; and a bearing support for the bar holder being formed by a profile piece which is provided with a fastening flange and which is received in a rectangular opening in the sheet metal fold or in the hollow profile of the door leaf.

11. The snap lock according to claim 10, wherein the hook is mounted at an extension of the profile piece and is forced into a locking position by the force of gravity or by a spring force.

12. The snap lock according to claim 10, wherein the bar holder forms a cam which slides along a cam path formed by the hook and, in so doing, swivels the hook about its swivel pin against the force of gravity or against the spring force.

13. The snap lock according to claim 11, wherein the bar holder forms a receptacle for a spring which forces the bar holder into a rest position.

14. The snap lock according to claim 13, wherein the spring is a pressure spring which contacts an inner surface of the profile piece.

15. The snap lock according to claim 10, wherein a surface of the fastening flange forms an opening, and wherein the bar holder forms a collar which extends at a slight distance from the flange surface and far enough so that the opening is covered by the collar during a swiveling movement of the holder.

16. The snap lock according to claim 10, wherein sidewalls of the profile piece have bore holes which are coaxial to one another and offset relative to the swivel pin, and so that a pin lock is adapted to be slidable into these bore holes.

17. The snap lock according to claim 16, wherein the pin lock can be controlled electrically.

* * * * *